10/15/85 4,547,300

United States Patent [19]

Lareau

[11] Patent Number: 4,547,300

[45] Date of Patent: Oct. 15, 1985

[54] LIQUID DETERGENT FABRIC CONDITIONING COMPOSITIONS

[75] Inventor: Mary R. Lareau, Randolph, N.J.

[73] Assignee: Beecham Inc., West Patterson, N.J.

[21] Appl. No.: 673,853

[22] Filed: Nov. 21, 1984

[51] Int. Cl.[4] ..... D04B 13/46

[52] U.S. Cl. ..... 252/8.8; 252/8.6; 252/174.21; 252/547

[58] Field of Search ..... 252/8.6, 8.8, 547, 174.21

[56] References Cited

U.S. PATENT DOCUMENTS

| | | | |
|---|---|---|---|
| 3,904,533 | 9/1975 | Neiditch et al. | 252/8.8 |
| 3,974,076 | 8/1976 | Wiersema et al. | 252/547 |
| 4,213,867 | 7/1980 | Cukier et al. | 252/8.8 |
| 4,214,998 | 7/1980 | Joy | 252/547 |
| 4,255,484 | 3/1981 | Stevens | 252/8.8 |
| 4,268,401 | 5/1981 | Meschkaf et al. | 252/547 |
| 4,328,110 | 5/1982 | Green | 252/8.8 |
| 4,417,995 | 11/1983 | Lips et al. | 252/8.8 |
| 4,427,558 | 1/1984 | David | 252/547 |
| 4,446,042 | 5/1984 | Leslie | 252/8.8 |

*Primary Examiner*—Paul Lieberman
*Assistant Examiner*—Willie Thompson
*Attorney, Agent, or Firm*—Jacobs & Jacobs

[57] ABSTRACT

Liquid detergent fabric conditioning composition containing novel and effective optical brightening agent. The composition contains both a cationic fabric conditioning agent and a nonionic surfactant in combination with an optical brightening amount of a $C_{21}$ dicarboxylic acid, salt thereof or mixture thereof and an aqueous solvent system.

30 Claims, No Drawings

LIQUID DETERGENT FABRIC CONDITIONING COMPOSITIONS

The present invention is concerned with liquid detergent fabric conditioning compositions containing a novel optical brightening agent, which compositions are added during the wash cycle of the laundering process.

It is known in the art to produce liquid and particulate laundry detergents and to add these during the wash cycle. It is also known in the art to add liquid fabric softener and anti-static compositions during the wash or rinse cycle of the laundering process. In recent years, it has been found convenient to separate the fabric softening and anti-static function from the detergent function by preparing a separate fabric softener and anti-static material which was added to the fabrics to be rendered soft and static-free during the drying cycle, rather than during the course of the wash or rinse cycle. It is also known in the art to prepare liquid detergents which also impart fabric softening and anti-static properties to fabrics during the course of the wash cycle of the laundering process.

More particularly, the following patents describe various detergent compositions for use during the wash cycle of the laundering process. U.S. Pat. No. 4,298,480 describes a detergent composition which provides softness, detergency, anti-static and anti-soil redeposition properties to fabrics and which comprises a water-soluble, non-soap, organic surfactant at least about 90% of which is of the anionic type, a water-soluble neutral to alkaline builder salt, a water-soluble or dispersible fatty acid soap in discrete particle form, a cationic softener selected from aliphatic di $C_1$–$C_4$ alkyl,di(higher) $C_{14}$–$C_{24}$ alkyl quaternary ammonium compounds, heterocyclic compounds and mixtures thereof, the weight ratio of soap to softener being from about 2:3 to 3:2 and wherein the percent concentration of anionic surfactant is at least about $1.5\times+5$, wherein x is the percent concentration of softener, wherein the soap is substantially homogeneously dispersed in the composition preferably as discrete particles. U.S. Pat. No. 4,294,711 describes granular detergent compositions which provide softening and cleaning properties and which comprise one or more polyethoxy nonionic detergents having a hydrophilic-lipophilic balance in the range of 8 to 15 and having not more than an average of 16 ethoxy units per molecule, one or more cationic surfactant materials, a detergency builder and an acid optical brightener of the 4,4'bis(triazinylamino) stilbene 2,2' sulphonic acid type having a low rate of solution in an aqueous medium of pH 9 at 25° C. U.S. Pat. No. 4,264,479 describes a mixture comprising a nonionic detergent, a tertiary amine oxide or amphoteric detergent and a quaternary ammonium halide. This surfactant system is combined with other ingredients to produce commercially useful cleaners. In column 3, lines 1, 2, 42 and 43, the mixture is stated to be a synergistic combination of surface active agents.

U.S. Pat. No. 4,268,401 describes a detergent composition comprising at least one nonionic surface active agent such as a $C_{10}$–$C_{20}$ alkylpolyglycol ether and/or a $C_6$–$C_{20}$ alkylphenolpolyglycol ether, at least one $C_8$–$C_{20}$ fatty acid polyglycol diester and at least one cationic component having textile-softening properties such as a di($C_{10}$–$C_{20}$)alkyl dimethyl or diethylammonium halide. U.S. Pat. No. 4,233,167 describes liquid detergent, softening, and brightening compositions which comprise a water-soluble nonionic surfactant system, at least one quaternary ammonium fabric softener having an equivalent weight of from about 400 to 2,000, an optical brightener of the 4,4' bis[4-di-substituted amino-6-(sulfosubstituted anilino)-s-triazin-2-ylamino]2,2'-stilbene disulfonic acid type and a hydrotrope to stabilize the composition. U.S. Pat. No. 4,222,905 describes laundry detergents containing no or only low levels of phosphate materials and specific mixtures of selected cationic surfactants, preferably those having reduced cationic monomer concentrations. U.S. Pat. No. 4,140,641 describes highly concentrated single phase liquid detergent compositions which contain a fabric softener which has been formulated using a nonionic surfactant and a quaternary imidazolinium fabric softener. The concentration of nonionic surfactant should be from about 40% to about 70% and the concentration of fabric softener is from about 15% to about 30%. Optical brighteners may also be added.

U.S. Pat. No. 4,202,800 describes liquid laundry detergent compositions comprising an alkanolamine, a nonionic surfactant, sodium carboxymethylcellulose and water. Optical brighteners may optionally be added. U.S. Pat. No. 3,982,356 describes a liquid laundry detergent and softener consisting of a detergent such as a linear primary alcohol ethoxylate such as a $C_{12}$–$C_{15}$ primary alcohol containing about 9-ethylene oxide units per mole, 8(4-hexyl-5-carboxycyclohex-2,3-ene-1-yl)octanoic acid preferably in the form of the disodium salt, an alkanolamine such as diethanolamine, and water. U.S. Pat. No. 3,959,157 describes a non-phosphate liquid detergent softening composition which comprises a nonionic and/or amine oxide surfactant, a mixture of a quaternary ammonium fabric softener and a polyethoxylated alkyl or dialkyl methyl ammonium halide and an aqueous solvent medium. U.S. Pat. No. 3,954,632 describes a fabric softening composition which contains as essential ingredients a particulate smectite clay fabric softening material, a quaternary ammonium fabric softening agent and an acidic compatibilizing agent selected from the group consisting of fatty acids having from about 8 to about 30 carbon atoms in the alkyl chain, benzene mono-, di- and tricarboxylic acid containing from 0 to 2 hydroxyl functions and mixtures thereof.

U.S. Pat. No. 3,920,564 describes the incorporation of cationic and amine fabric softeners into anionic and nonionic detergent compositions where the builder is a water-soluble salt of an amino-polycarboxylate or a water-soluble salt of citric acid rather than the usual sodium or potassium tripolyphosphate. The substitution of an aminopolycarboxylate salt or a citric acid salt for tripolyphosphate as a builder is stated to increase the functionality of cationic and amine-type fabric softeners in a detergent fabric softener.

U.S. Pat. No. 3,844,952 describes laundry detergent compositions comprising a water-soluble organic detergent compound an $\alpha,\omega$-disubstituted derivative of a non-cyclic, hygroscopic polyol, and in a preferred embodiment a polyalkyleneimine anti-static agent. U.S. Pat. No. 3,766,062 describes fabric softening compositions consisting essentially of a higher 1,2-alkanediol, a linear alkyl benzene sulfonate and a higher alkylol sulfate. U.S. Pat. No. 3,749,691 describes detergent compatible fabric softening compositions comprising a cationic softening agent, an amphoteric surfactant and a modified polyolefin emulsion. U.S. Pat. No. 3,537,993 describes detergent softener compositions consisting essentially of from about 3% to about 9% of a nonionic detergent, from about 4% to about 15% of a zwitterionic amine oxide, an amide detergent or a mixture thereof, a detergency builder, and from about 2% to about 8% of a quaternary ammonium fabric softener.

Canadian Pat. No. 1,110,409 describes liquid formulations for fabric treatment which comprise a first dispersed phase consisting of particles comprising a mixture of substantially water insoluble organic matrix materials, a cationic material and a sensorially perceivable material dispersed in an aqueous phase. Canadian Pat. No. 1,052,506 describes a fabric softening composition comprising from about 7 to about 15% by weight of a cationic fabric softening agent, up to about 10% of a lower aliphatic alcohol and an aqueous vehicle substantially free of electrolytes. Canadian Pat. No. 1,032,051 describes detergent compositions which comprise a mixture of surfactants of which 30–90% by weight is a surfactant selected from among nonionic surfactants, amphoteric surfactants and mixtures thereof and from 10–70% as a surfactant mixture comprising at least one anionic surfactant and at least one cationic surfactant in a charged ratio of anionic surfactant to cationic surfactant within the range of from about 0.60 to about 0.90. Canadian Pat. No. 1,031,907 describes non-phosphate detergents consisting essentially of about 10 to about 40% of a synthetic organic detergent selected from $C_{16}$–$C_{22}$ alkyl di-($C_1$–$C_3$)alkylamineoxide, water-soluble nonionic surface active compounds derived from condensation of a $C_8$–$C_{50}$ hydrophobic compound with from 5 to 200 moles of ethylene oxide or a mixture thereof and about 3 to 15% of a mixture of a quaternary ammonium fabric softener which is a di-long chain or di-short chain quaternary ammonium compound or a mono- or di-long chain alkylimidazolinium compound and a polyethoxylated quaternary ammonium compound containing from 10 to 60 moles of ethylene oxide, the elements in the composition being present in specified ratios.

Canadian Pat. No. 1,005,204 is a typical example of a dryer-added fabric softener which comprises a substrate having a fabric conditioning agent thereon which is co-mingled with the clothes to be conditioned in the laundry dryer.

Canadian Pat. No. 818,419 describes fabric softener detergent compositions comprising an electro-neutral complex of a cationic textile softening agent and an anionic surfactant and a nonionic -cationic dispersing mixture which is capable of dispersing the composition into an active dispersion. The electro-neutral complex is stated to make up a critical portion of the composition and is formed by combining a cationic textile softening agent with an anionic surfactant in the presence of a nonionic -cationic dispersing agent in amounts which will form a substantially unionized cationic-anionic complex.

Canadian Pat. No. 783,532 describes detergent softener compositions which comprise a nonionic detergent and a cationic softener and a nonionic soil suspending agent, the detergent and the fabric softener being present in a ratio by weight of from about 0.5:1 to 2.5:1. The nonionic detergent is a condensation product of polyethyleneoxide in which the polyethyleneoxide chain acts as the hydrophilic group and the hydrophobic group is derived from materials such as fatty acids, alcohols, mercaptans, amines, amides, substituted phenols, fatty alcohols and glucosides.

Canadian Pat. No. 755,039 describes a fabric softening composition which can be used during the wash cycle of the laundering process together with a laundry detergent. The fabric softeners described are cation-active organic compounds which are capable of forming solid complexes that are adducts with urea.

Canadian Pat. No. 743,513 describes compositions comprising a cationic fabric softening agent which is a water-soluble 1-lower alkyl, 1-long chain alkylamidoethyl-2-long chain alkyl imidazolinium salt and a germicidal agent which is a water-soluble N-alkyl, N,N-dilower alkyl N-arylmethyl ammonium salt having a long chain alkyl group. As with the preceeding Canadian patent, this composition is intended to be added during the laundering process and does not include a detergent within the composition.

Canadian Pat. No. 730,150 describes the chemical treatment of fibrous material such as textiles and paper for the purpose of providing softness to those materials. This reference discloses 1,2-amide imidazoline salts which are stated to have good re-wetting and good anti-static properties for textiles and paper. Canadian Pat. No. 713,521 describes solid laundry compositions comprising a mixture of a cationic fabric softener and a sugar. The sugar is used as a carrier, stabilizer and solubilizer for the fabric softener. Canadian Pat. No. 702,646 describes a fluid colloidal preparation which comprises at least one cationic fabric softener which is preferentially absorbed by cloth, at least one organomercurial germicide, and a minor proportion of thin boiling cornstarch. The cationic softener is stated to exert a potentiating effect upon the germicidal activity of the organomercurial compound as well as aiding in more uniform absorption of the germicide into the fabrics being treated with the composition.

By contrast to the prior art, the present invention provides a liquid detergent fabric conditioning composition which contains a novel and effective optical brightening agent. The composition according to the present invention contains both a cationic fabric conditioning agent and a non-ionic surfactant. Most optical brightening agents do not perform well in cationic systems, such as those of the present invention. While most optical brighteners are compatible with anionic surfactants, they lose their effectiveness when they are combined with cationic and non-ionic surfactants. It is therefore most surprising that the optical brightening agent used in the composition of the present invention is effective, not only because it is utilized in a fabric conditioning system containing a cationic fabric conditioning agent and a non-ionic surfactant, but because the agent has not been heretofore known as possessing or exhibiting any optical brightening characteristics.

More particularly, the present invention provides a liquid detergent fabric conditioning composition which comprises an effective amount of a cationic fabric conditioning agent, an effective amount of a non-ionic surfactant having detergent properties compatible with said cationic fabric conditioning agent, an optical brightening amount of a $C_{21}$ dicarboxylic acid, salt thereof or mixture thereof and an aqueous solvent system. The $C_{21}$ dicarboxylic acid and salts thereof, which are useful as optical brightening agents in the composition of the present invention, are described in U.S. Pat. No. 3,966,628 as surfactants. The $C_{21}$ dicarboxylic acid is represented by the structural formula:

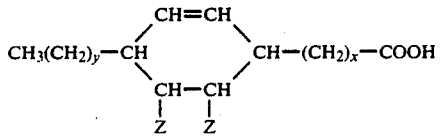

wherein x and y are integers from 3 to 9, x and y together = 12, one Z is hydrogen and the other Z is a carboxylic acid group (COOH). Isomers wherein x is 5 and y is 7 frequently form a preponderance of the acid composition, although there may be minor amounts of the $C_{21}$ dicarboxylic acid where the cyclohexene ring varies in position along the carbon chain.

As the important aspect of the optical brightening agent used in the composition of the present application is the substituted cyclohexene structure, the optical brightening agent may be used in the form of the di-acid, a di-salt, a mono-acid/mono-salt or a mixture thereof.

The importance of the one site of unsaturation in the cyclohexene ring is perhaps best displayed by the fact that the saturated analog does not exhibit optical brightening. According to one embodiment of the present invention, the $C_{21}$ dicarboxylic acid or salt thereof which is the optical brightening agent used in the composition of the present invention is of the formula:

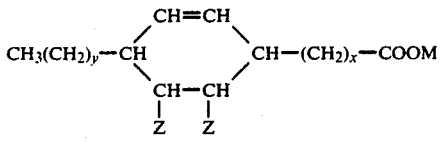

wherein x and y are integers from 3 to 9 and x and y together = 12, Z is H or $COOM_1$ wherein one Z is hydrogen and the other is $COOM_1$ wherein M and $M_1$ are hydrogen, sodium, potassium, lithium, ammonium or mixtures thereof. According to a preferred embodiment of the present invention, the optical brightening agent is in the form of the di-potassium salt.

Any cationic fabric conditioning agent which is compatible with fabrics with which it will contact during the wash cycle of the laudering process, and which will impart softness and anti-static properties to such fabrics during the wash cycle, and which is compatible with the $C_{21}$ dicarboxylic acid, salts thereof and mixtures thereof and the non-ionic surfactant may be used. Similarly, any non-ionic surfactant which has detergent properties, is compatible with the cationic fabric conditioning agent, is compatible with the $C_{21}$ dicarboxylic acid, salts thereof and mixtures thereof and is compatible with the fabrics with which it will contact during the wash cycle of the laundering process may be used. Any suitable, compatible aqueous solvent system may be used to formulate the composition into a liquid form suitable for addition to the wash cycle of the laundering process.

The non-ionic surfactant and cationic fabric conditioning agent are preferably present in the weight ratio of 1:1 to 20:1. The preferred weight ratio of non-ionic surfactant to $C_{21}$ dicarboxylic acid (or salt or mixtures thereof) is 1:1 to 50:1. The preferred weight ratio of cationic fabric conditioning agent to $C_{21}$ dicarboxylic acid (or salt or mixtures thereof) is 1:1 to 10:1.

According to one embodiment of the present invention, the $C_{21}$ dicarboxylic acid, salt thereof or mixture thereof is present in the amount of about 0.4% to 10%, particularly about 2% to about 8%. From about 2% to about 6%, and from about 2% to about 5% have been found to be quite useful. From about 3% to about 5% has been found to be particularly useful. The compositions of the present invention may, if desired, contain effective amounts of dyes, fragrances, anti-soil redeposition agents, buffering agents, opacifiers, preservatives and the like, as well as other additives commonly found in liquid detergents, fabric softening and anti-static compositions. If desired, the compositions according to the present invention may also contain an effective amount of a compatible anti-microbial agent.

While a wide range of cationic fabric conditioning agents may be utilized, quaternary ammonium compounds have been found to be particularly useful. From about 0.5% to about 12%, particularly from about 5% to about 12% and especially from about 6% to about 10% have been found to be useful.

According to a further aspect of the present invention, the composition of the present invention is used to launder and impart conditioning including brightening to fabrics during the wash cycle of a laundering process by adding to the fabrics during the wash cycle an effective amount of a composition according to the present invention comprising an effective amount of a cationic fabric conditioning composition as above defined, an effective amount of a non-ionic surfactant having detergent properties with appropriate compatibility as above defined, an optical brightening amount of the $C_{21}$ dicarboxylic acid, salt thereof or mixture thereof as above defined, and a suitable compatible aqueous solvent system.

The non-ionic surfactant and cationic fabric conditioning agent are preferably present in the weight ratio of 1:1 to 20:1. The preferred weight ratio of non-ionic surfactant to $C_{21}$ dicarboxylic acid (or salt or mixtures thereof) is 1:1 to 50:1. The preferred weight ratio of cationic fabric conditioning agent to $C_{21}$ dicarboxylic acid (or salt or mixtures thereof) is 1:1 to 10:1.

According to one embodiment of the present invention, the $C_{21}$ dicarboxylic acid, salt thereof or mixture thereof is present in the amount of about 0.4% to 10%, particularly about 2% to about 8%. From about 2% to about 6%, and from about 2% to about 5% have been found to be quite useful. From about 3% to about 5% has been found to be particularly useful. The compositions of the present invention may, if desired, contain effective amounts of dyes, fragrances, anti-soil redeposition agents, buffering agents, opacifiers, preservatives and the like as well as other additives commonly found in liquid detergents, fabric softening and anti-static compositions. If desired, the compositions according to the present invention may also contain an effective amount of a compatible anti-microbial agent.

The cationic fabric conditioning agent may be a quaternary ammonium compound. Preferred ranges of cationic fabric conditioning agent are from about 0.5% to about 12%, from about 5% to about 12%, and from about 6% to about 10%.

Suitable quaternary ammonium compounds include those of the formula:

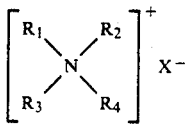

(I)

wherein X is an anion, preferably a halide (particularly chloride) or methyl sulfate, $R_1$ and $R_2$ are each alkyl of 1 to 3 carbon atoms, $R_3$ is benzyl, alkyl of 1 to 3 carbon atoms, a polyethoxy moiety containing up to about 10 ethylene oxide units, alkoxypropyl or hydroxy substituted alkoxypropyl wherein the alkoxy moiety contains 12–20 carbon atoms, alkyl of 12 to 20 carbon atoms, alkyl amido wherein the alkyl moiety contains from 12 to 20 carbon atoms, and $R_4$ is alkyl of 12 to 20 carbon atoms, a polyethoxy moiety containing up to about 10 ethylene oxide units, or alkyl amido wherein the alkyl moiety contains 12–20 carbon atoms.

Particularly useful quaternary ammonium compounds include:

Tallowtrimethyl ammonium chloride
Tallowdimethyl (3-tallowalkoxypropyl) ammonium chloride
Ditallow dimethyl ammonium chloride
Ditallow dimethyl ammonium methyl sulfate
Eicosyltrimethyl ammonium chloride
Dieicosyldimethyl ammonium chloride
Dodecyltrimethyl ammonium chloride
Didodecydimethyl ammonium chloride
Tetradecyltrimethyl ammonium chloride
Ditetradecyldimethyl ammonium chloride
Pentadecyltrimethyl ammonium chloride
Dipentadecyldimethyl ammonium chloride
Didodecyldiethyl ammonium chloride
Didodecyldipropyl ammonium chloride
Ditetradecyldiethyl ammonium chloride
Ditetradecyldipropyl ammonium chloride
Ditallowdiethyl ammonium chloride
Ditallowdipropyl ammonium chloride
Tallowdimethyl benzyl ammonium chloride
Tallowdiethyl benzyl ammonium chloride
Dodecyltrimethyl ammonium methyl sulfate
Di(oxyethylene) tallow methyl ammonium chloride Other cationic fabric conditioning agents of formula (I) are known and include variables wherein $R_1$ and $R_2$ are phenyl or hydroxy substituted alkyl of 1 to 3 carbon atoms.

Cationic imidazolinium compounds useful in the compositions of the present invention include those represented by the formula (II):

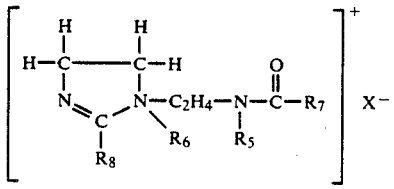

(II)

wherein $R_6$ is alkyl of 1–4 carbon atoms, preferably from 1–2 carbon atoms, $R_7$ is hydrogen or alkyl of 1 to 4 carbon atoms, $R_8$ is alkyl of 8–25 carbon atoms, preferably at least 15 carbon atoms, $R_5$ is hydrogen or alkyl of 8–25 carbon atoms, preferably at least 15 carbon atoms, and X is an anion, preferably methyl sulfate or chloride. Particularly preferred are those compounds of formula (II) in which both $R_5$ and $R_8$ are alkyl of 16–25 carbon atoms, particularly 16–18 carbon atoms.

According to a further embodiment of the present invention, when the cationic fabric conditioning agent is a quaternary ammonium compound it may be a single quaternary ammonium compound or a mixture of quaternary ammonium compounds. The relative proportions in the mixture will be dependent upon the relative performance attributes of detergency, softening and static control which are desired. Particularly useful mixtures of quaternary ammonium compounds include:

ditallow dimethyl ammonium chloride with Di(oxyethylene) tallow methyl ammonium chloride
ditallow dimethyl ammonium chloride with methyl-1-oleyl-amidoethyl-2-oleyl imidazolinium methyl sulfate and
ditallow dimethyl ammonium chloride with diamido methyl ethoxylated ammonium methyl sulfate.

Any nonionic surfactant which is compatible with the cationic fabric conditioning agent and the other specific ingredients in a given composition may be used. Nonionic surfactants useful for this purpose are known in the art. Useful nonionic surfactants include the water-soluble products derived from the condensation of an alkylene oxide or equivalent reaction and a reactive-hydrogen hydrophobe. The hydrophobic compounds may be aliphatic, aromatic or heterocyclic, although the aliphatic and aromatic ones are preferred. The preferred types of hydrophobes are higher aliphatic alcohols and alkylphenols, although other hydrophobes may be used such as carboxylic acid, carboxamides, mercaptans, sulphonamides and the like. The ethylene oxide condensates with higher-alkylphenols and are a preferred class of nonionic compounds. Usually the hydrophobic moiety contains at least 6 carbon atoms, and preferably about 15 carbon atoms. The amount of alkylene oxide will vary considerably depending upon the hydrophobe, but as a general guide, at least 5 moles of alkylene oxide per mole of hydrophobe should be used. The upper limit of alkylene oxide will also vary. While ethylene oxide is the preferred oxyalkylating reagent, other lower alkylene oxides such as propylene oxide, butylene oxide and the like may be used or substituted in part for the ethylene oxide. Preferred hydrophobic moieties contain about 9 moles on the average of ethylene oxide, although greater amounts may also be employed.

Another preferred group of nonionic surfactants includes the class of oxyalkylated higher aliphatic alcohols. The fatty alcohols should contain at least 6 carbon atoms and preferably from 12–15 carbon atoms. Useful alcohols should be condensed with at least about 5 moles of ethylene oxide and preferably about 9 moles of ethylene oxide per mole of alcohol. A typical product is a C-12 to C-15 mixture of alcohols condensed with 9 moles of ethylene oxide.

The use of the $C_{21}$ dicarboxylic acid, salts thereof and mixtures thereof as the optical brightening agent is particularly surprising both because it was heretofore unknown that the acid, salts and mixtures would provide optical brightening and because they provide optical brightening in a cationic/non-ionic system. It is also surprising that the acid, salts and mixtures may be used in amounts as high as 10% because it is known in the art that when the amount of optical brightening agent rises over 1 to 2%, consumer negatives result in the product and large amounts of optical brightening agents are therefore not utilized in the prior art. It is therefore most surprising that effective whitening of fabrics is obtained with the dicarboxylic acid, salts thereof or mixtures thereof over the ranges described above.

The following non-limitative examples more particularly illustrate the present invention:

EXAMPLE 1

A liquid detergent fabric conditioning composition was prepared by admixing the following ingredients:

| | % w/w |
|---|---|
| Ethoxylated nonyl phenol (9 moles of ethylene oxide) | 20.00 |
| Di(oxyethylene) tallow methyl ammonium chloride | 4.88 |
| Ethyl alcohol | 4.00 |
| $C_{21}$ dicarboxylic acid, salts thereof or mixtures thereof | 4.00 |
| Perfume, Dye } as desired | |
| Water qs | |

The recommended use amount per average washer load of 5–7 lbs. of dry fabric is ½ cup.

EXAMPLE 2

A liquid detergent fabric conditioning composition was prepared by admixing the folowing ingredients:

| | % w/w |
|---|---|
| Ethoxylated nonyl phenol (9 moles of ethylene oxide) | 20.00 |
| Di(oxyethylene) tallow methyl ammonium chloride | 4.88 |
| $C_{21}$ dicarboxylic acid, salts thereof or mixtures thereof | 4.00 |
| Perfume, Dye } as desired | |
| water qs | |

The recommended use amount per average washer load of 5–7 lbs. of dry fabric is ½ cup.

EXAMPLE 3

A liquid detergent fabric conditioning composition was prepared by admixing the following ingredients:

| | % w/w |
|---|---|
| Ethoxylated nonyl phenol (9 moles of ethylene oxide) | 13.33 |
| Di(oxyethylene) tallow methyl ammonium chloride (75% active) | 3.25 |
| $C_{21}$—dicarboxylic acid, salts thereof or mixtures thereof | 2.67 |
| Perfume, Dye } as desired | |
| Water qs | |

The recommended use amount per average washer load of 5–7 lbs. of dry fabric is ¾ cup.

EXAMPLE 4

A liquid detergent fabric conditioning composition was prepared by admixing the following ingredients:

| | % w/w |
|---|---|
| Ethoxylated nonyl phenol (9 moles of ethylene oxide) | 20.00 |
| Di(oxyethylene) tallow methyl ammonium chloride (75% active) | 4.88 |
| Ethylene glycol monostearate | 2.00 |
| $C_{21}$—dicarboxylic acid, salts thereof or mixtures thereof | 4.00 |
| Opacifier | 0.20 |
| Perfume, Dye } as desired | |
| Water qs | |

The recommended use per average washer load of 5–7 lbs. of delicate fabrics is ¼ cup.

EXAMPLE 5

A liquid detergent fabric conditioning composition was prepared by admixing the following ingredients:

| | % w/w |
|---|---|
| Ethoxylated nonyl phenol (9 moles of ethylene oxide) | 12.50 |
| Methyl-1-oleylamido ethyl-2-oleyl imidazolinium methyl sulfate | 0.95 |
| $C_{21}$—dicarboxylic acid, salts thereof or mixtures thereof | 0.40 |
| Sodium chloride | 6.60 |
| Perfume, Dye } as desired | |
| Water qs | |

The recommended use per average washer load of 5–7 lbs. of dry fabric is ½ cup.

EXAMPLE 6

A liquid detergent fabric conditioning composition was prepared by admixing the following ingredients:

| | % w/w |
|---|---|
| Ethoxylated nonyl phenol (9 moles of ethylene oxide) | 12.50 |
| Methyl-1-oleylamido ethyl-2-oleyl imidazolinium methyl sulfate | 0.95 |
| Monoethanolamine salt of coconut fatty acids | 3.50 |
| $C_{21}$—dicarboxylic acid, salts thereof or mixtures thereof | 0.40 |
| Sodium chloride | 6.60 |
| Perfume, Dye } as desired | |
| Water qs | |

The recommended use per average washer load of 5–7 lbs. of dry fabric is ½ cup.

What is claimed is:

1. A detergent fabric conditioning composition capable of imparting detergency, softness, anti-static and brightening properties to fabrics treated therewith during the wash cycle of a laundering process which comprises a fabric conditioning amount of a cationic fabric conditioning agent having fabric softening and anti-static properties, an effective amount of a non-ionic surfactant having detergent properties which is compatible with said cationic fabric conditioning agent, an optical brightening amount of a $C_{21}$ dicarboxylic acid optical brightening agent of the formula:

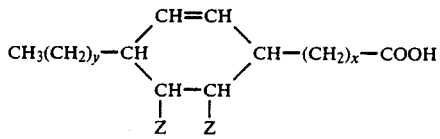

a salt thereof or a mixture thereof wherein x and y are integers from 3 to 9, and x and y together = 12, one Z is hydrogen and the other Z is COOH or a salt thereof and an aqueous solvent system.

2. A composition according to claim 1 wherein x is 5 and y is 7.

3. A composition according to claim 1 wherein the $C_{21}$ dicarboxylic acid or salt thereof is of the formula:

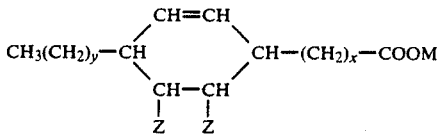

wherein x and y are integers from 3 to 9 and x and y together = 12, Z is H or $COOM_1$ wherein one Z is hydrogen and the other is $COOM_1$ wherein M and $M_1$ are hydrogen, sodium, potassium, lithium, ammonium or mixtures thereof.

4. A composition according to claim 1 which contains the $C_{21}$ dicarboxylic acid as the optical brightening agent.

5. A composition according to claim 1 which contains a mono-salt of the $C_{21}$ dicarboxylic acid.

6. A composition according to claim 1 which contains a di-salt of the $C_{21}$ dicarboxylic acid.

7. A composition according to claim 1 which contains a mixture selected from two or more of the $C_{21}$ dicarboxylic acid, a mono-salt thereof and a di-salt thereof.

8. A composition according to claim 6 wherein the di-salt is the di-sodium or di-potassium salt.

9. A composition according to claim 1 wherein the weight ratio of non-ionic surfactant to optical brightening agent is 1:1 to 50:1.

10. A composition according to claim 1 wherein the weight ratio of cationic fabric conditioning agent to optical brightening agent is from 1:1 to 10:1.

11. A composition according to claim 1 wherein the cationic fabric conditioning agent is a quaternary ammonium compound.

12. A composition according to claim 1 which comprises about 5% Di(oxyethylene) tallow methyl ammonium chloride, 20% ethoxylated nonyl phenol (9 moles of ethylene oxide), 4% ethyl alcohol, 4% $C_{21}$ dicarboxylic acid, salt thereof or mixtures thereof, and water qs.

13. A composition according to claim 1 which comprises about 5% Di(oxyethylene) tallow methyl ammonium chloride, 20% ethoxylated nonyl phenol (9 moles of ethylene oxide), 4% $C_{21}$ dicarboxylic acid, salt thereof or mixtures thereof, and water qs.

14. A composition according to claim 1 which contains 4% of the dipotassium salt of the $C_{21}$ dicarboxylic acid as the optical brightening agent.

15. A method of laundering fabrics and imparting softness and anti-static properties and brightening to fabrics treated therewith during the wash cycle of a laundering process which comprises adding to said fabrics during the wash cycle, an effective amount of a composition which comprises a fabric conditioning amount of a cationic fabric conditioning agent having fabric softening and anti-static properties, an effective amount of a non-ionic surfactant having detergent properties which is compatible with said cationic fabric conditioning agent, an optical brightening amount of a $C_{21}$ dicarboxylic acid optical brightening agent of the formula:

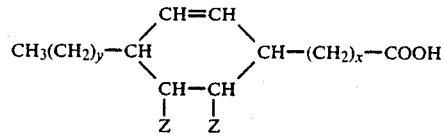

a salt thereof or a mixture thereof wherein x and y are integers from 3 to 9, and x and y together = 12, one Z is hydrogen and the other Z is COOH or a salt thereof and an aqueous solvent system.

16. A method according to claim 15 wherein x is 5 and y is 7.

17. A method according to claim 15 wherein the $C_{21}$ dicarboxylic acid or salt thereof is of the formula:

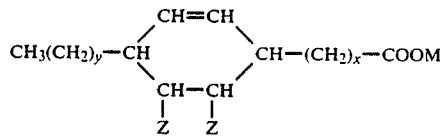

wherein x and y are integers from 3 to 9 and x and y together = 12, Z is H or $COOM_1$ wherein one Z is hydrogen and the other is $COOM_1$ wherein M and $M_1$ are hydrogen, sodium, potassium, lithium, ammonium or mixtures thereof.

18. A method according to claim 15 which contains the $C_{21}$ dicarboxylic acid as the optical brightening agent.

19. A method according to claim 15 which contains a mono-salt of the $C_{21}$ dicarboxylic acid.

20. A method according to claim 15 which contains a di-salt of the $C_{21}$ dicarboxylic acid.

21. A method according to claim 15 which contains a mixture selected from two or more of the $C_{21}$ dicarboxylic acid, a mono-salt thereof and a di-salt thereof.

22. A method according to claim 15 wherein the di-salt is the di-sodium or di-potassium salt.

23. A method according to claim 15 wherein the weight ratio of non-ionic surfactant to optical brightening agent is 1:1 to 50:1.

24. A method according to claim 15 wherein the weight ratio of cationic fabric conditioning agent to optical brightening agent is from 1:1 to 10:1.

25. A method according to claim 15 wherein the cationic fabric conditioning agent is a quaternary ammonium.

26. A method according to claim 15 which comprises about 5% Di(oxyethylene) tallow methyl ammonium chloride, 20% ethoxylated nonyl phenol (9 moles of ethylene oxide), ethyl alcohol, 4% $C_{21}$ dicarboxylic acid, salt thereof or mixtures thereof, and water qs.

27. A method according to claim 15 which comprises about 5% Di(oxyethylene) tallow methyl ammonium chloride, 20% ethoxylated nonyl phenol (9 moles of ethylene oxide), 4% $C_{21}$ dicarboxylic acid, salt thereof or mixtures thereof, and water qs.

28. A method according to claim 15 which contains 4% of the dipotassium salt of the $C_{21}$ dicarboxylic acid as the optical brightening agent.

29. In a detergent fabric conditioning composition capable of imparting detergency, softness, anti-static and brightening properties to fabrics treated therewith during the wash cycle of a laundering process, which composition contains a cationic fabric conditioning agent having softness and anti-static properties and a non-ionic surfactant having detergent properties, the improvement which comprises utilizing as the optical brightening agent in said composition an optical brightening amount of a $C_{21}$ dicarboxylic acid of the formula:

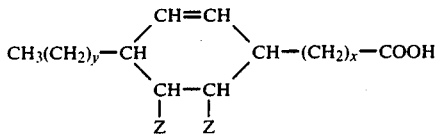

a salt thereof or a mixture thereof wherein x and y are integers from 3 to 9 and x and together = 12, one Z is hydrogen and the other Z is COOH or a salt thereof.

30. In a method of laundering fabrics and imparting softness and anti-static properties and brightening to fabrics treated therewith during the wash cycle of a laundering process, the improvement which comprises adding to said fabrics during the wash cycle an effective amount of a composition which contains a cationic fabric conditioning agent having fabric softening and anti-static properties and a non-ionic surfactant having detergent properties, which contains as the optical brightening agent an optical brightening amount of a $C_{21}$ dicarboxylic acid of the formula:

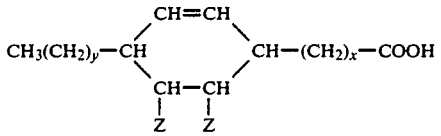

a salt thereof or a mixture thereof wherein x and y are integers from 3 to 9, and x and together = 12, one Z is hydrogen and the other Z is COOH or a salt thereof.

* * * * *